United States Patent [19]

Levi

[11] Patent Number: 4,653,406

[45] Date of Patent: Mar. 31, 1987

[54] DEVICE FOR THE CLAMPING AND THE AUTOMATIC CATCHING OF VEHICLES TO THE DRIVING CABLE OF AERIAL TRANSPORT PLANTS

[75] Inventor: Ferruccio Levi, Milan, Italy

[73] Assignee: Leitner S.P.A., Vipiteno, Italy

[21] Appl. No.: 774,719

[22] Filed: Sep. 11, 1985

[30] Foreign Application Priority Data

Sep. 14, 1984 [IT] Italy ..... 23109/84[U]

[51] Int. Cl.[4] ..... B61B 12/12

[52] U.S. Cl. ..... 104/211; 104/209; 104/216; 104/224

[58] Field of Search ..... 104/173 ST, 202, 205, 104/209, 211, 214, 215, 216, 204, 206, 217, 224

[56] References Cited

U.S. PATENT DOCUMENTS

| | | | |
|---|---|---|---|
| 2,955,544 | 10/1960 | Goirand | 104/206 X |
| 3,037,464 | 6/1962 | Penney et al. | 104/216 X |
| 3,610,164 | 10/1971 | Feuz | 104/211 X |
| 4,441,430 | 4/1984 | Brochand | 104/211 X |

*Primary Examiner*—Robert B. Reeves
*Assistant Examiner*—Scott H. Werny
*Attorney, Agent, or Firm*—Oblon, Fisher, Spivak, McClelland & Maier

[57] ABSTRACT

A vise is constituted by a stationary jaw and a movable jaw, pivoted to each other, and suitable to be clamped onto a cable by means of the action of at least one spring. The stationary jaw is prolonged into a supporting pin for the vehicles, and the movable jaw is prolonged into a lever controlling its opening or closure onto the driving cable in cooperation with the stationary jaw. The spring acts between the supporting pin and the control lever to keep them open wide apart relative to the hinging axis of the jaws.

4 Claims, 3 Drawing Figures

DEVICE FOR THE CLAMPING AND THE AUTOMATIC CATCHING OF VEHICLES TO THE DRIVING CABLE OF AERIAL TRANSPORT PLANTS

FIELD OF THE INVENTION

The present invention relates to an improved device for the automatic clamping, the catching, and the releasing of a vehicle to and from the driving cable of monocable or bicable plants for the aerial transport of people, such as chairlifts, cableways and so forth, and/or of freight, such as freight telpherages.

DESCRIPTION OF THE INVENTION

Devices known of this type comprise generally a vise, one of whose jaws is fixed, the other one of whose jaws is movable and clamps the cable against the fixed jaw due to the presence of elastic means.

Such devices have been essentially developed to be applied and used in cableways with closed cars to be kept within suitable stores during the stages during which the plant is out of service. The purpose of this is to not expose the vise and the catching device in general to the inclemency of the weather, such as snow and ice, which render difficult or unsafe its operation.

The devices used for the chairlifts of the so-called light type are generally simple derivatives of such devices, and hence do not take a full advantage of the possibilities offered by the single vise, and they are not explicitly designed for the long exposure to the inclemency of the weather. Additionally, due to their initial origin, they show a certain difficulty in the check of the clamping efficiency, or at least said check is complex, not very reliable, and expensive.

OBJECTS OF THE INVENTION

The principal object of the present invention is to overcome the drawbacks of the prior art by providing a device with very high operating reliability.

Further objects include the particular structural simpleness and the consequent lower costs of actuation, of course always in compliance with the safety rules in force, even in case of neglected maintenance and/or use conditions in particularly hostile environments.

A further object of the invention is that the device must allow a very simple, reliable, and cheap check of the efficiency of the clamping at each departure of the vehicle from the station.

SUMMARY OF THE INVENTION

These and further objects, according to the present invention, are achieved by accomplishing a device for the clamping and the automatic catching of vehicles onto a driving cable of plants for the aerial transport of people and/or freight, of the type comprising a vise constituted by a fixed jaw and a movable jaw pivoted to each other. The vise can be clamped onto the cable by means of the action of at least one elastic means. The fixed jaw is extended into a supporting pin for the vehicles, and the movable jaw is mounted on a lever controlling its opening or closure onto the driving cable in cooperation with the fixed jaw. The elastic means act between the supporting pin and the control lever to keep them open wide apart relative to the hinging axis of the jaws.

Preferably in the device the elastic means is constituted by two parallel springs. Each spring is coaxial to a guide rod, and the guide rods are at one of their ends constrained in an articulated way to the control lever. At the other end of the guide rods, they are articulated onto the pin and axially sliding relative to the axis of the springs. Stopping and stroke-limiting means suitable to prevent the outcoming of the springs and to keep them loaded are provided.

BRIEF DESCRIPTION OF THE DRAWINGS

The structural and functional characteristics and the advantages of a device according to the present invention will be better understood from the following exemplifying and not limitative disclosure, relating to the attached schematic drawings, wherein.

DETAILED DESCRIPTION OF THE PRESENTLY PREFERRED EMBODIMENT

Figure 1:
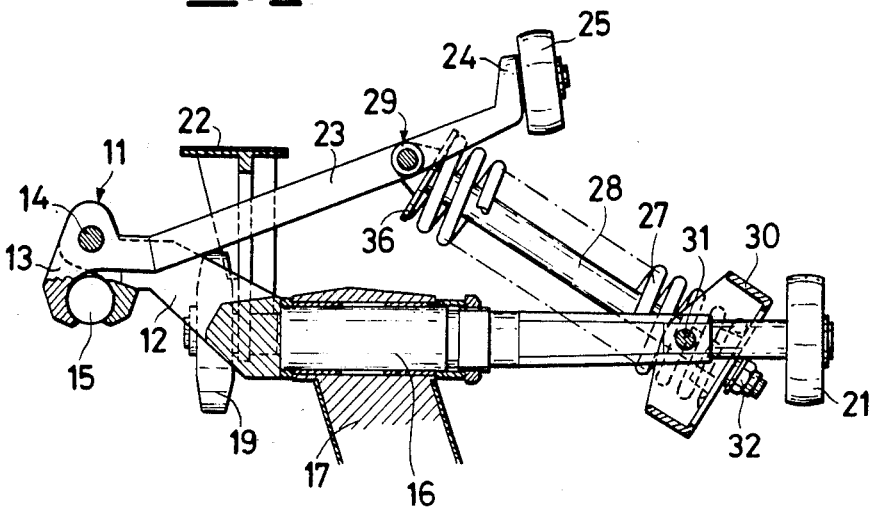
FIG. 1 is an elevation view of a device according to the present invention clamped onto a driving cable.

Referring to the drawings, a device according to the present invention comprises a vise 11 composed by a stationary jaw 12 and a movable jaw 13, pivoted to each other at 14 and suitable to clamp a driving cable 15. The stationary jaw 12 is attached horizontally to a supporting pin 16 that supports an arm 17 of a vehicle (not shown) such as a multi-seat chair.

Figure 3:
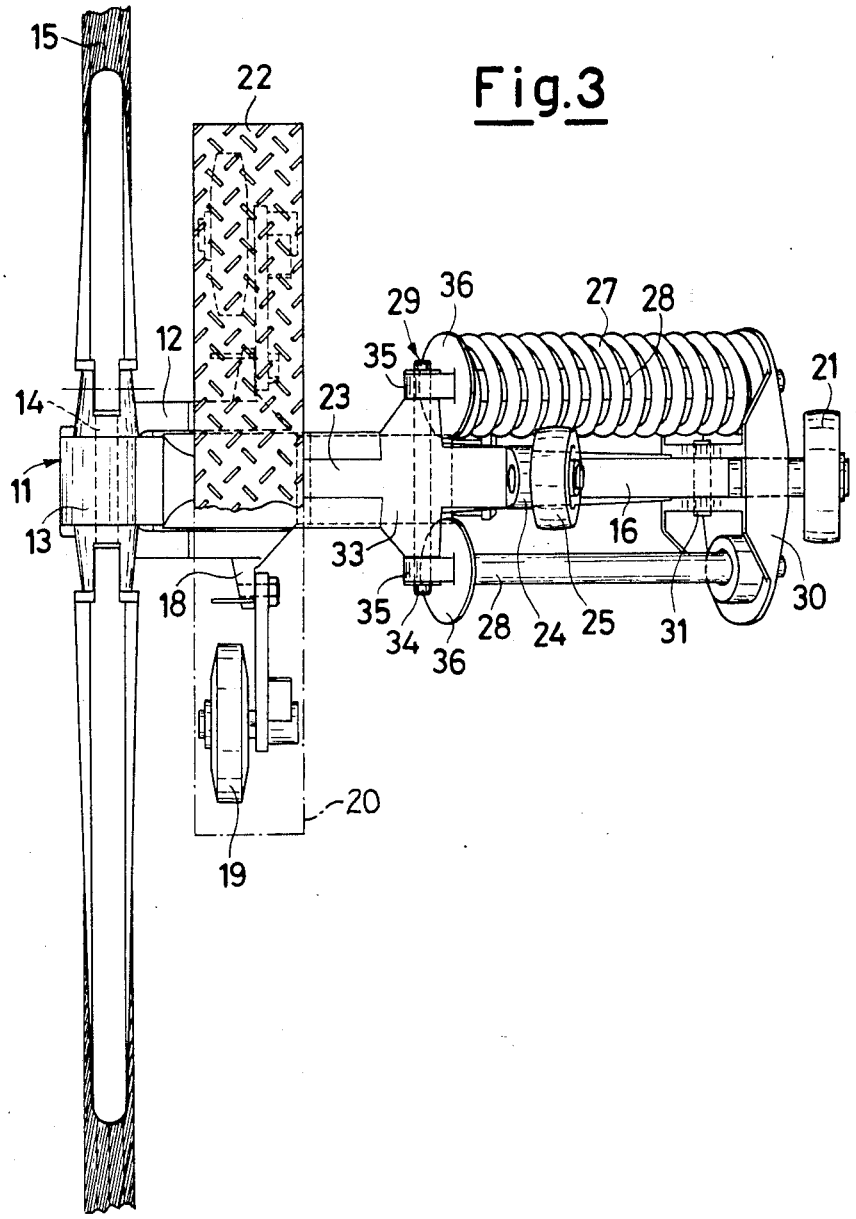
FIG. 3 is a top plan view of the device of FIG. 1.

As shown in FIG. 3, the end of the supporting pin 16 between the stationary jaw 12 and the arm 17 of the vehicle bears laterally protruding on opposite sides two projections 18 bearing wheels 19 that slide on guide rails 20 provided in the stations. A dragging block 22 is positioned above the jaws 12, 13.

The other free end of the supporting pin 16 is provided with at least one wheel 21 that slides on a guide rail 20'.

The movable jaw 13 is prolonged into a control lever 23 ending at its free end with a square element 24 having its free end of rounded shape. The square element 24 supports a rotary element or wheel 25 suitable to operatively act on shaped guide surfaces 26 provided above and in correspondence with the guide rails 20, 20' in the stations. The rounding radius of the square element 24 is slightly lower than the radius of the wheel 25.

Between the supporting pin 16 and the control lever 23 two elastic means or helical springs 27 are provided. The helical springs 27 are guided by respective rods 28. Each rod 28 is pivoted at one end 29 to the control lever 23. At the other end each rod 28 passes through a shaped plate 30. The shaped plate 30 is pivoted at 31 to the supporting pin 16.

The free ends of the rods 28 bear unilateral stopping means 32 such as nuts or related washers.

The pivot 29 is constituted in the example by an enlarged and bored portion 33 of the control lever 23 suitable to receive a small pin 34 for fastening eyes 35 of the rods 28. Washers 36 are mounted on the rods 28 for the containment of the helical springs 27.

The two parallel helical springs 27 have a long stroke, and are positioned at a mutual distance such that no interference occurs between the helical springs 27, square element 24, and the wheel 25.

The way that the foregoing device for the clamping and a automatic catching of the vehicle onto a driving cable operates is as follows.

The individual vehicles (not shown) are clamped by means of the vise 11 in its closed position to the driving cable 15 (FIG. 1). In the case of a monocable type plant, the drive cable 15 acts also as the track cable.

When the vehicle comes into a station, the wheels 19 and 21 engage the guide rails 20, 20', and the dragging block 22 interacts with something (e.g., with a set of wheels 37) to gradually brake the vehicle.

Almost at the same time, the wheel 25, positioned on the control lever 23, interacts with the shaped guide 26 positioned above it. This interaction obliges the control lever 23 to move downwardly.

Figure 2:
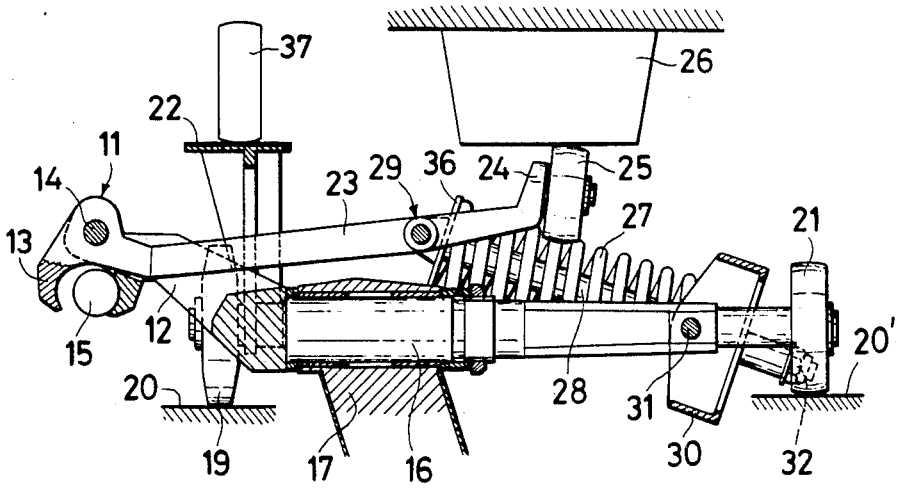
FIG. 2 is a view equivalent to that of FIG. 1 with the vise open.

This action causes the opening of the vise 11 (FIG. 2), caused by the rotation of the movable jaw 13 around the pivot 14, the compression of the helical springs 27 made possible by the sliding of the rods 28, and by the presence of the pivot 29 and the pivot 31.

In a known way the vehicle is then dragged into its departure position, wherein a second set of wheels 37 with increasing speed is present.

The operation of the closure of the vise 11 there takes place, determined by a second shaped guide surface 26 which acts on the control lever 23 opening and then closing again the vise 11 onto the cable 15, in cooperation with the helical springs 27.

A device according to the present invention is hence provided with a kinematic mechanism displaying a plurality of well defined characteristics, which can be summarized as follows:

great structural simpleness, with a limited number of components, and hence a limited number of couplings in relative motion;

structure of the "open" type, so as to allow an immediate access and avoid the collection of snow or of ice within cavities from which their withdrawal is difficult;

accurate design of the couplings, selected in such a way that the movement of the kinematic mechanism facilitates the removal of any accumulated mass of snow, avoiding its compacting;

elastic system constituted by two "long stroke" parallel helicl springs, so as to easily break any possible ice layer by twisting deformation; the two springs are completely separated and not coaxial, so as to easily allow the passage of the snow through their turns; the assemblage is carried out in such a way that damage to one spring does not impair the efficiency of the other one;

the "long stroke" of the springs guarantees also a relative insensitiveness to the small unevennesses in the mechanism due to machining tolerances;

the kinematic mechanism is of direct type, in the sense that the thrust of the springs acts directly between the stationary jaw and the movable jaw, without the interposition of connecting rods, cams, or levers, and also the opening of the vise takes place directly through a wheel mounted on the lever of the movable jaw; and the kinematic mechanism is free from a dead point, and hence the vise has only one resting configuration, in its closure position; in such a way, sharp variations of the opening and closure stresses are avoided, with a decrease in the dynamic stresses, and a greater comfort for the vehicle's passengers.

The thrust of the springs is directly transmitted between the fixed jaw and the movable jaw, and the actual clamping stress is simply the product of the springs thrust times the ratio of the arms relatively to the pivoting of the jaws.

The kinematic mechanism has been accomplished in such a way that to the spring's length variation such a variation of the arm corresponds, as to keep sensibly constant their product, for a wide range of the actual diameter of the cable. In such a way, a sufficient clamping is always secured, but overdimensionings of the springs and of the elements connected to them are not necessary.

The vise, relative to the position of normal closure, allows a further safety stroke allowed by the length still available in the guide rods, before the stopping against the plate.

This further stroke is hence securing a sufficient clamping also with a lower diameter of the cable, or even in the presence of ovalized cable portions.

A device according to the present invention includes structural provisions to avoid the possibility of a missed releasing from the cable on entering the station:

the opening force is applied directly to the movable jaw through a guide wheel; the movement of the jaw is hence obliged by the geometrical shape of the guide surface installed in the station;

in case of breaking or of lack of the guide wheel, the opening takes anyway place due to the sliding of the surface against the square element of the lever, having a suitably radiused profile;

also in case of breaking of the jaw in its portion between the wheels and the articulation of the spring, an emergency opening of the vise is still possible by acting on the free length of the lever 23, comprised between the dragging block 22 and the pivot 29, thus allowing the disengagement of the cable.

So, as at least three opening possibilities exist, it is not necessary to envisage any rapid breaking for possible missed unclamping.

An automatic device according to the present invention is hence recommended for chairs of from two to four seats, it being particularly light, simple, and reliable.

Moreover, by coupling two or more devices according to the present invention, it is possible to use vehicles for six, eight, or more people.

I claim:

1. A device for the clamping and the automatic catching of a vehicle on a driving cable, said device comprising:

(a) an arm that, in use, is attached to a vehicle;

(b) a fixed member mounted in said arm, said fixed member having a first end ending in a stationary jaw projecting in a first direction from said arm and a second end projecting in a second direction, opposite to the first direction, from said arm;

(c) a first pivot pin mounted in the first end of said fixed member;

(d) a second pivot pin mounted in the second end of said fixed member;

(e) a control lever pivotably mounted on said first pivot pin, said control lever having a first end ending in a movable jaw sized, shaped, and positioned to cooperate with said stationary jaw to releasably grip a driving cable and a second end ending in a bearing housing the external surface of which is rounded to function as an emergency cam follower;

(f) a third pivot pin mounted in the second end of said control lever;

(g) a plate pivotally mounted on said second pivot pin;

(h) a pair of parallel, spaced control rods mounted on said third pivot pin, said pair of parallel, spaced control rods passing through said plate on opposite sides of the second end of said fixed member;

(i) a pair of helical compression springs, one of said pair of helical compression springs being concentrically mounted on each one of said pair of parallel, spaced control rods and bearing at one end against said third pivot pin and at the other end against said plate; and (j) a first wheel mounted on the second end of said control lever, said first wheel having a radius greater than the external surface of said bearing housing, whereby, when said first wheel or said bearing housing contacts a cam surface during use of the device, (k) said control rod pivots about said first pivot pin in a first angular direction, thereby moving said movable jaw away from said stationary jaw and releasing the driving cable, and (l) said pair of helical compression springs are compressed, storing the energy to pivot said control rod about said first pivot pin in a second angular direction, opposite to the first angular direction, thereby moving said movable jaw back towards said stationary jaw when a cam surface permits them to do so.

2. A device as recited in claim 1 and further comprising:

(a) a second wheel mounted on the first end of said fixed member and positioned to contact and ride on a guide rail when the vehicle enters a station and (b) a third wheel mounted on the second end of said fixed member in position to contact and ride on a guide rail when the vehicle enters a station.

3. A device as recited in claim 1 wherein said fixed member, said control lever, and said pair of parallel, spaced control rods are sized and shaped so that:

(a) when said movable jaw is clamped on the driving cable, said pair of parallel, spaced control rods project away from said control lever by a first oblique angle opening toward ssid fixed member;

(b) when said movable jaw is pivoted away from said stationary jaw, said pair of parallel, spaced control rods project away from said control lever by a second oblique angle opening toward said fixed member; and (c) said second oblique angle is larger than said first oblique angle.

4. A device as recited in claim 3 wherein said second oblique angle is nearly equal to said first oblique angle, whereby the force exerted on said control lever by said pair of helical compression springs does not vary greatly during the pivotal movement of said control lever.

* * * * *